US005383166A

United States Patent [19]

Gallay

[11] Patent Number: 5,383,166

[45] Date of Patent: Jan. 17, 1995

[54] WATERTIGHT CONTROL DEVICE FOR WATCHES

[75] Inventor: Jacques-André Gallay, Les Avanchets, Switzerland

[73] Assignee: Montres Rolex S.A., Switzerland

[21] Appl. No.: 13,082

[22] Filed: Feb. 3, 1993

[30] Foreign Application Priority Data

Feb. 12, 1992 [CH] Switzerland ..... 00424/92

[51] Int. Cl.[6] ..... G04B 37/00; G04B 29/00

[52] U.S. Cl. ..... 368/288; 368/319

[58] Field of Search ..... 368/286–290, 368/318–320

[56] References Cited

U.S. PATENT DOCUMENTS 3,499,281 3/1970 Denley et al. ..... 368/289

3,621,649 11/1971 Vulcan et al. ..... 368/290

4,626,108 12/1982 Ganter ..... 368/291

*Primary Examiner*—Vit W. Miska

*Attorney, Agent, or Firm*—Cushman, Darby & Cushman

[57] ABSTRACT

A watch control device comprises a crown with a central cavity surrounded by an annular cavity in the bottom of which is formed a groove. The lateral external face of the annular cavity has a thread adapted to be screwed onto a thread formed on the lateral external face of an external part of a tube screwed into a watch casing. An injected thermoplastic elastomer seal is disposed in the annular cavity. This seal comprises two parts of the same external diameter, but of different internal diameter, the portion of greater diameter engaging in the groove and the portion of smaller diameter being that on which the tube acts in the screwed up position of the crown.

5 Claims, 1 Drawing Sheet

WATERTIGHT CONTROL DEVICE FOR WATCHES

BACKGROUND OF THE INVENTION present invention relates to a control device for a watch, for example for winding up the watch or setting the time or date.

Such a control device typically comprises a crown with a central cavity surrounded by an annular cavity, a watertight seal arranged in the annular cavity, and a sleeve fixed at its end in the central cavity. A control rod is arranged inside the sleeve, the rod and sleeve having complementary coupling means allowing the rod to be driven in rotational and translational movement. A spring is arranged in the sleeve between the end thereof and that of the control rod for engaging the said coupling means. A tube integral with the watch casing, inside which the sleeve is free to move, and has a projecting part adapted to be screwed into the annular cavity of the crown and, in the screwed-in position, to compress the watertight seal at its end.

DESCRIPTION OF THE PRIOR ART

A control device of this type is described in Swiss Patent No. 308,031. In this device, the watertight seal disposed in the annular cavity is a seal with a rectangular section, obtained by cutting out from a sheet of elastomer of the desired thickness. The side of the seal adjacent the bottom of the annular cavity is glued to prevent the seal from turning in the cavity during screwing up of the crown.

The fact that the seal is cut out from a sheet means that it has a rectangular cross section. The space available at the base of the annular cavity means that the small side of the rectangle corresponds to the thickness of the seal, such that a flat seal is attained. As a result, when the crown is screwed in, the compression ratio for the seal is large in view of its small thickness (in the order of 0.3 mm).

When the crown is connected to a rewinding and time-setting rod of an automatically winding watch, it can remain screwed in for several days, or possibly several consecutive weeks.

Given these constraints, it has been observed that a slight residual deformation can be induced over the long term in the thickness of the seal, which does not confer on it optimal efficiency.

Besides, given the very small dimensions of such a seal (its diameter is in the order of 3.5 mm and the width of its cross section of 0.6 mm), its gluing and placement constitute an extremely delicate operation.

Indeed, it has already been proposed in FR-A-2,002,866 to form seals not by cutting, but by molding. Nevertheless, such seals can only be obtained one at a time. A precise amount of molding material must be introduced in the mold before closing the latter, which, given the aforementioned dimensions, creates difficult problems to resolve. The production output of such seals is obviously very much less than that of cut out seals. It is for this reason that the molding of seals is not used in practice, above all for seals as small as those for winding crowns. Furthermore, the molding does not allow sufficient accuracy to be guaranteed for the dimensions, such that this manufacturing technique does not satisfy any of the demands required for wheels for watertight watch control devices. Besides, since the elastomers employed, whether natural or synthetic are not injectable, only cut out seals exist on the market.

An object of the present invention is to provide an improved watertight watch control device.

SUMMARY OF THE INVENTION

According to the invention,the watertight seal is an injected part made of thermoplastic elastomer having a cross section complementary to that of the annular cavity.

The principal advantage of such an arrangement comes from the fact that one is no longer limited to a seal of rectangular cross-section, as is the case for cut-out joints. The elastomer used also has mechanical properties that satisfy the requirements and for which the quality is perfectly constant from one production run to another. The volume of the seal can be substantially increased without adversely affecting the rigidity of the crown, which permits the compression ratio of the material to be reduced. The surface contact between the seal and its recess in the crown can also be greatly increased.

As a result, the watertightness between the seal and the crown is improved. The same applies to the frictional force between the seal and the crown. This frictional force resists the rotation of the seal in its groove and reduces the scissoring force exerted on the adhesive surface of the seal during the screwing and unscrewing of the crown.

Other advantages will appear from the description which follows and the attached drawing which illustrates, schematically and by way of example, one embodiment of the control device forming the object of the present invention.

DESCRIPTION OF PREFERRED EMBODIMENTS

Figure 1:
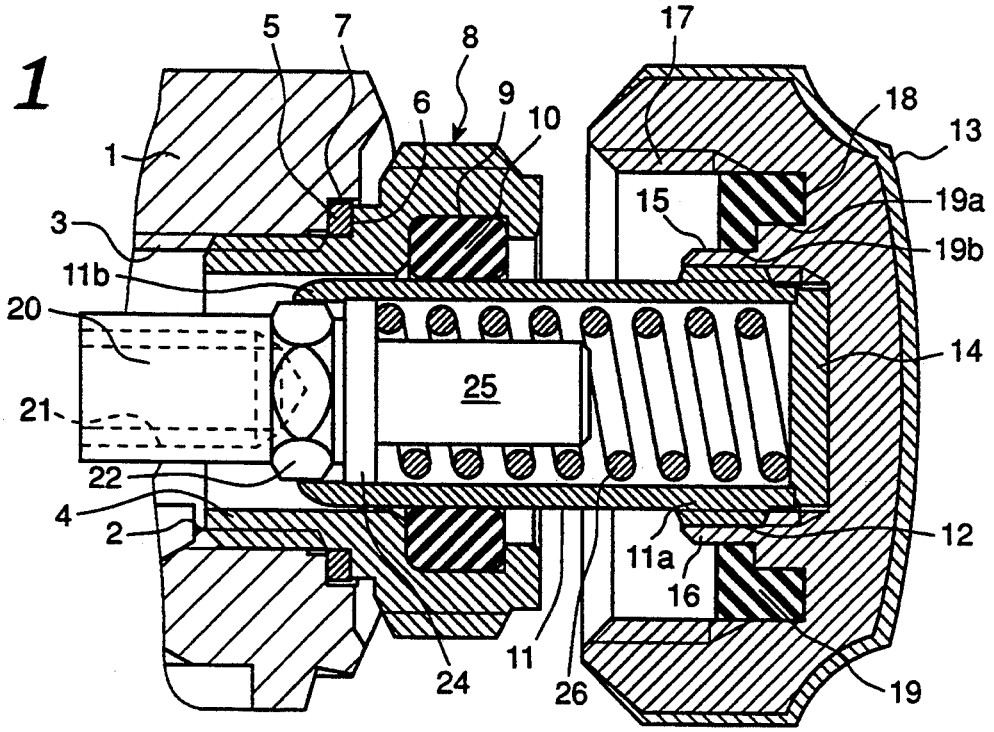
FIG. 1 is a partial sectional view of a watch casing provided with a control device illustrated with the crown unscrewed.
Figure 2:
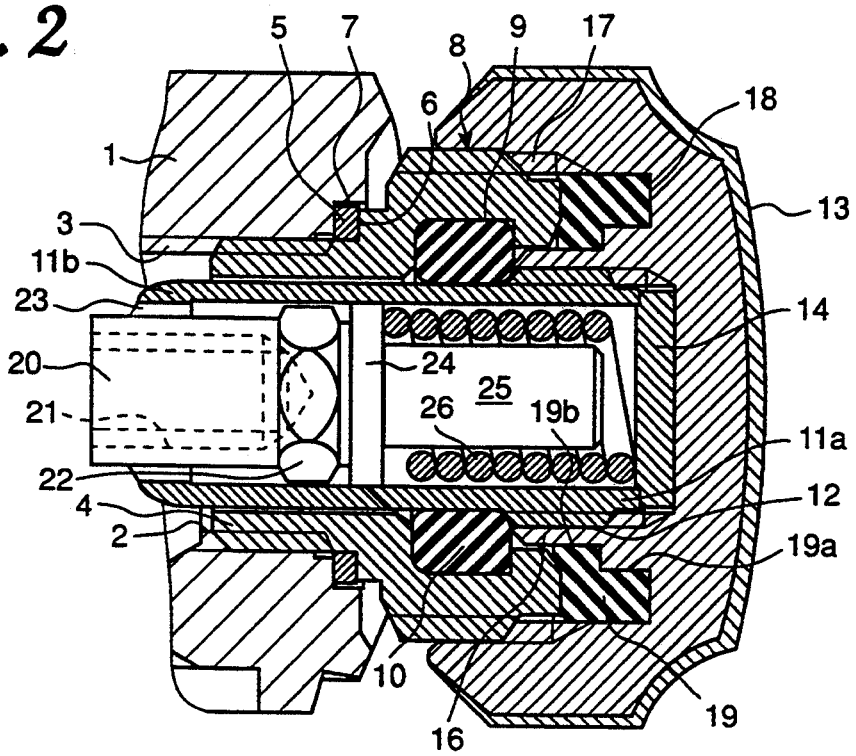
FIG. 2 is a view similar to that of FIG. 1, illustrated with the crown screwed up.

FIGS. 1 and 2 show very partially the part of the casing 1 traversed by the control device forming the object of the invention. This casing 1 has a passage 2 provided with a thread 3 into which a tube 4 is screwed. A metallic watertight seal 5 is located between a shoulder 6 of the tube 4 and a recess 7 surrounding the entrance to the passage 2.

The part of the tube 4 situated outside the casing is outwardly flared and its external face 8 is threaded, while an annular groove 9 is formed in the lateral internal face of this widened part of the tube 4. An O-ring seal 10 is arranged in this groove and is compressed between the latter and a sleeve 11 whose extremity 11a is screwed into a thread formed in a central cavity 12 of crown 13. A disk-shaped metallic seal 14 is placed at the bottom of the central cavity 12, and the extremity 11a of the sleeve engages against the periphery of the seal 14 to guarantee a watertight seal between the crown 13 and the sleeve 11.

An annular cavity 15 surrounds the central cavity 12, tubular wall 16 separating these two cavities. The lateral external wall of the annular cavity 15 is provided with a thread 17, which is complementary to the thread of the lateral external face 8 of the widened part of the tube 4. The bottom of the annular cavity has a groove 18 that extends the lateral external face of the annular cavity. This groove 18 is narrower than the annular cavity so as not to weaken the base of the tubular wall 16, which is stressed by the screwing up of the sleeve 11 against the metallic field 14.

Part of the annular cavity 15 and the groove 18 are occupied by watertight seal 19 of complementary shape, that is to say which comprises two annular portions of the same external diameter, but having different internal diameters. The portion of greatest internal diameter 19*a* is that which is engaged in the groove 18, that of least internal diameter 19*b* occupies the bottom of the annular cavity 15. It is against its free face that the end of the tube 4 is applied in the screwed up position of the crown 13 (FIG. 2).

The lower part of the sleeve 11 encloses a coupling mechanism comprising a coupling member 20 having at one end thereof a threaded bore 21 for receiving the end of a control rod, in particular a control rod for winding up the watch and setting the time, and possibly also for setting the date. The coupling member 20 forms an integral part of the control rod. On the external face of this coupling member is located a part of polygonal section 22. This cross section is complementary to that 23 which is formed at the end 11*b* of sleeve 11. A thin truncated cylindrical section 24 is formed on the coupling member adjacent the part of polygonal cross section 22 and on the side thereof remote from the threaded bore 21. The diameter of the truncated section 24 is chosen so as to permit it to slide freely inside the sleeve 11 and abut the end of the straight polygonal section 23 of the sleeve 11. A cylindrical part of smaller diameter than the cylindrical section 24 terminates this coupling member 20.

A coil spring 26 is arranged in the sleeve 11 around the cylindrical part 25. It abuts, on the one hand, the metallic seal 14 and on the other hand, the shoulder formed between the cylindrical section 24 and the cylindrical part 25.

As can be seen in FIG. 2, when the crown 13 is screwed onto the tube 4, the rod integral with the coupling member prevents the latter from being displaced axially with the crown 13, so that the spring 26 is compressed, and at the same time, the parts 22 and 23 of the straight complementary polygonal cross sections become axially separated, so that the coupling member 20 is not driven in rotation during the screwing and unscrewing of the crown 13.

On the contrary, as soon as the crown 13 is unscrewed, the spring 26 urges the shoulder formed between the truncated cylindrical section 24 and the part of polygonal cross section 22 against the shoulder formed at the end 11*b* of sleeve 11 by the part polygonal cross section 23, so that the sleeve 11, which is integral with the crown 13 and accompanying member 20, rotate together. The respective adjacent shoulders of the section 23 and the truncated cylindrical section 24 additionally permit the axial displacement of the coupling member 20 and thus the rod, which is integral with, it toward the outside, in one of several positions, to allow the setting of the time and possibly the date.

Given its shape, the seal 19 cannot be obtained by conventional techniques, that is to say by cutting out from a sheet material or by the molding technique employed for the fabrication of O-ring seals. As is known, the elastomers utilized for manufacturing such aforementioned seals are not made of injectable material. This without doubt explains why, at least in the field of watch-making which is of interest here, the seals are either of rectangular section or circular section. As for the rare exceptions, they are found only in the literature.

The seal 19 is made by injection. To this end, a thermoplastic elastomer is employed, which is an intermediate between rubber and plastic, that is to say that at ambient temperature has the properties of vulcanized rubber, while at a high temperature it melts like a thermoplastic. As a result, such an elastomer can be easily treated with conventional equipment used for thermoplastic material and can particularly by molded by injection. No final treatment is necessary since this elastomer does not vulcanize.

In an exemplary embodiment the thermoplastic elastomer has a base of 55% by weight of soft segments of PTHF glycol with a molecular weight of about 1000 and 45% by weight of hard segments derived from 1,4-butanediol and methyltherephthalate. Preferably, a polyester type thermoplastic elastomer is employed and that is sold under the trade mark Hytrel ® by DuPont and preferably a high performance Hytrel ® which has additional advantages relating to mechanical resistance and operating life for the most demanding applications. Among this type of thermoplastic elastomer, can be selected Hytrel ® 7246, but preferably Hytrel ® 5526 which has better properties for the present application.

Hytrel ® is the registered trade mark of DuPont de Nemours for the range of its technical thermoplastic elastomers. These are copolymer blocks, constituted of hard segments (crystallines) of polybutylene terephthalate and of soft segments (amorphous) based on long chain polyether glycols. Their properties are determined by the value of the ratio between the hard and soft segments and their arrangement.

Hytrel ® is a technical thermoplastic elastomer bringing together a number of the most desirable characteristics associated with high performance elastomers and soft plastics. It has in particular the following properties: exceptional resilience and tenacity; high flow resistance; flexibility at low temperatures and good maintenance of its properties at high temperatures. Further, it resists derogation caused by numerous industrial chemical products, oils and solvents.

That being so, the fact of making an injected seal 19 of the shape illustrated in the drawings increases considerably the surface contact between the seal and its recess relative to a flat seal having the shape only of part 19*b*, such that the frictional force is substantially increased, which is important in the case of a screwed crown. Nevertheless, preferably, the seal 19 is glued to ensure a mounting rendering impossible any attempt at removal without destruction. For matters of safety, as to the watertightness of the crown, it is in effect necessary, if need be, to change the entire crown and not replace the seal. In effect, its mounting and its gluing constitute a delicate operation which can only be ensured correctly at the time of manufacture. Furthermore, the adhesive surface must be perfectly smooth and clean, which cannot be guaranteed if the seal is changed.

As previously indicated, Hytrel ® is a thermoplastic elastomer, which is very difficult to glue. To this must be added the very small dimensions of the seal and the fact that the glue must in no case come into contact with the free face of the seal. It must be sufficiently fluid so as not to form a local excess thickness capable of deforming the flatness of the free face. It must finally not set too rapidly so as to allow working under industrial conditions.

Two solutions have been found: one consists in using, on the one hand, a two-part glue with a polyurethane base sold under the mark Thixon® 412/413 which allows an optimum gluing between 10 and 20 minutes after application on the seal, an application which can be carried out with precision and evenly by grinding, and on the other hand, Thixon® 403/404 which is a single layer dual component adhesive agent that is placed on the metallic surfaces of the bottom of the cavity 15 and of the bottom of the groove 18. Thixon® 403/404 is used for the gluing onto metal of various polyurethane elastomers. Previously, the metal is degreased with trichlorethylene vapor and allowed to dry for 30 minutes at ambient temperature. The separate equal components of the Thixon® mixture 403/404 can be applied with a gun (volumetric dilution 60 parts with a mixture 403/404, 40 parts xylene). The mixture is allowed to dry for 30 to 40 minutes at ambient temperature. The thickness of the dry film of Thixon® to be applied can be in the order of 25 to 30 μm.

The surfaces of the seal to be glued are cleaned and degreased by means of a solvent such as methyl ethyl ketone. They are left to dry from 30 minutes to one hour before the application of Thixon® 412/413 mixed in equal parts and allowed to dry for 10 to 20 minutes.

The other solution consists in applying an activator to the surfaces of the seal to be glued. This activator has a base of ethyl ethanol/acetate sold under the mark Pascoprime ®. Finally, on to this activator is applied a glue sold under the mark Pascopepp ®.

I claim:

1. In a watertight control device for watches, comprising a crown with a central cavity surrounded by an annular cavity, a watertight seal disposed in the said annular cavity, a sleeve fixed at one end thereof in said central cavity, a watch control rod disposed inside said sleeve, said watch control rod and the other end of said sleeve having complementary coupling means for driving said rod in rotation and translational movement, a spring located in said sleeve between said one end thereof fixed in the said central cavity and the end of the control rod for engaging said coupling means, and a tube fixed to the casing of the watch, in the interior of which tube said sleeve is free to move and having a projecting part adapted to be screwed into said annular cavity of the crown and, in the screwed-up position, to compress said watertight seal at its end, the improvement wherein said watertight seal is an injected part made of thermoplastic elastomer having a cross section complementary to that of said annular cavity, said annular cavity comprising a groove formed in its bottom, said seal comprising two annular portions of the same external diameter, but diameter internal diameters, the annular portion of greater diameter engaging in said groove and the portion of smaller diameter being that on which the tube acts in the screwed-up position of the crown.

2. A device according to claim 1, wherein said seal is of generally L-shaped cross section.

3. A device according to claim 1, wherein said thermoplastic elastomer has a base of 55% by weight of soft segments of PTHF glycol with a molecular weight of about 1000 and 45% by weight of hard segments derived from 1,4-butanediol and methylterephthalate.

4. A device according to claim 3, wherein the thermoplastic elastomer is Hytrel® 5526.

5. A device according to claim 1, wherein the seal is glued with the aid of a dual-component single layer adhesive system with a polyurethane base resistant to oil and solvent abrasion, deposited on the elastomer and a dual-component single layer adhesive agent that is placed on the bottom of the metallic surface of the said annular cavity of the crown against which it is desired to glue the said seal.

* * * * *

UNITED STATES PATENT AND TRADEMARK OFFICE

CERTIFICATE OF CORRECTION

PATENT NO. : 5,383,166

DATED : January 17, 1995

INVENTOR(S) : GALLAY

It is certified that error appears in the above-indentified patent and that said Letters Patent is hereby corrected as shown below:

In Column 6, line 17, "diameter" (second occurrence) should be --different--.

Signed and Sealed this

Twentieth Day of June, 1995

Bruce Lehman

*Attest:*

BRUCE LEHMAN

*Attesting Officer*

*Commissioner of Patents and Trademarks*